United States Patent [19]

Jensen et al.

[11] Patent Number: 4,877,372

[45] Date of Patent: Oct. 31, 1989

[54] MULTI-STAGE ROTARY PUMP

[75] Inventors: Niels D. Jensen; Erik Svarre, both of Bjerringbro, Denmark

[73] Assignee: Grundfos International A/S, Bjerringbro, Denmark

[21] Appl. No.: 240,085

[22] Filed: Sep. 2, 1988

[30] Foreign Application Priority Data

Sep. 4, 1987 [DE] Fed. Rep. of Germany ..... 3729673

[51] Int. Cl.[4] ..... F04D 29/62

[52] U.S. Cl. ..... 415/199.1; 415/214.1

[58] Field of Search ..... 415/199.1, 199.2, 199.3, 415/201, 219 C, 219 R, 501, DIG. 3

[56] References Cited

U.S. PATENT DOCUMENTS

| | | | |
|---|---|---|---|
| 2,366,964 | 1/1945 | Howard | 415/199.3 |
| 2,753,807 | 7/1956 | Lung | 415/199.2 |
| 4,244,675 | 1/1981 | Bower | 415/199.1 X |
| 4,669,956 | 6/1987 | Brunel et al. | 415/219 C X |

FOREIGN PATENT DOCUMENTS

| | | | |
|---|---|---|---|
| B 21571 | 10/1956 | Fed. Rep. of Germany . | |
| 1528708 | 5/1970 | Fed. Rep. of Germany | 415/199.2 |
| 3523599.3 | 1/1987 | Fed. Rep. of Germany . | |
| 57-83697 | 5/1982 | Japan | 415/219 C |
| 732293 | 6/1955 | United Kingdom | 415/199.2 |

OTHER PUBLICATIONS

Grundfos Kreisel-Pumpen Publication

*Primary Examiner*—Randall L. Green
*Assistant Examiner*—Joseph M. Pitko
*Attorney, Agent, or Firm*—Balogh, Osann, Kramer, Dvorak, Genova & Traub

[57] ABSTRACT

A multistage rotary pump, which comprises a substantially closed pump body having a jacket surrounding the pump body in spaced relationship for the purpose of forming an annular return volume, a base element comprising suction and pressure connecting pieces and a top element comprising the driving motor. The jacket is provided in both its terminal portions with a peripheral contact shoulder which is acted upon in each case by an annular clamping arrangement, the clamping arrangement in question being connected on the other hand to the base element and top element, respectively. A coupling device of this nature is preferentially applied in the case of in-line rotary pumps.

2 Claims, 3 Drawing Sheets

MULTI-STAGE ROTARY PUMP

BACKGROUND OF THE INVENTION

1. Field of the Invention

The invention relates to a multistage rotary pump comprising a substantially closed, elongated pump body which is provided at one of its extremities with a base element containing suction and pressure connecting pieces and at its other extremity with a top element and which is surrounded in spaced relationship by a jacket to form an annular return volume, and clamping devices joining the jacket to the base element and the top element, the jacket being sealed with respect to these elements and being provided at least substantially close to its two extremities with contact shoulders of stable form which are acted upon by the clamping devices.

2. Description of the Prior Art

A motor-pump assembly is described in German Pat. No. 35 23 599, in which the thin-walled jacket of the motor housing is provided with a contact shoulder which co-operates with a clamping ring which is thrust against the contact shoulder by means of spring force. This clamping joint for connecting the motor section and pump section is costly to produce, since the thin-walled jacket of the motor section has to be reduced in its terminal portion by turning in several stages, in order to form a stable contact shoulder. Furthermore, the thin-walled jacket has to be very carefully chucked in a lathe to be able to produce a precisely fitting contact shoulder.

Another generally known solution of joining the jacket to the terminal pump elements comprises clamping the jacket between the terminal elements by mean of tension rods, the tension rods being screw-coupled to the terminal elements. Since flat joints are commonly clamped between the jacket extremities and the terminal elements in the case of this solution, the problem exists of excessive compression of the flat joints when a pump fluid flows past the jacket particularly at very high temperature and the latter consequently expands correspondingly in length, because the tension rods which are spaced from the jacket thus understandably do not accompany the longitudinal expansion to the same degree. This results in a destruction of the flat joints in the course of time.

SUMMARY OF THE INVENTION

It is an object of the present invention to provide an improved multistage rotary pump of the kind referred to hereinabove, to the effect that, in the case of in particular utilization of flat joints, a reliable and durable connection which may be produced cheaply is established between the thin jacket and the terminal elements with defined end side.

According to the invention, this object is resolved by the provision of a multistage rotary pump of the kind referred hereinabove and which is further characterized in that the terminal sections of the jacket are each provided with a pressed-in peripheral groove, that an annular element projecting outwards radially with respect to the jacket and forming the said contact shoulder is inserted into each of the two grooves and that an axially stressed clamping ring acts on the said annular element.

Thanks to this solution, a cheaply producible, operationally reliable and durable connection is obtained between the jacket extremities and the corresponding terminal elements in particular in the case of a thin jacket, without the occurrence of a deformation of the jacket in its terminal portions as well as in its other portions which is caused by mechanical stress as a consequence of the coupling forces or of other forces, because the known long tension rods extending along the jacket are eliminated and a coupling system acting on the jacket in a protective manner is provided instead. This coupling system furthermore allows the utilization of axially stressed joints, in particular flat joints, between the jacket extremities and the terminal elements, without having to expose the jacket extremities to a costly and particularly complex shaping process and without an excessive compression, i.e. an increase beyond the areal stress acceptable for the jointing material, arising. Radially stressable joints may alternately also be utilized between the terminal jacket portions and the terminal elements. Moreover, relative displacements between the jacket and the joint utilized in each case, which are to be feared upon switching the pump motor on and off, are also prevented, since a comparatively powerful frictional lock prevails on the sufficiently wide contact shoulders of the jacket.

The present invention will be described by way of example in the following detailed description taken in conjunction with the accompanying drawings.

DETAILED DESCRIPTION OF THE PREFERRED EMBODIMENT

Figure 1:
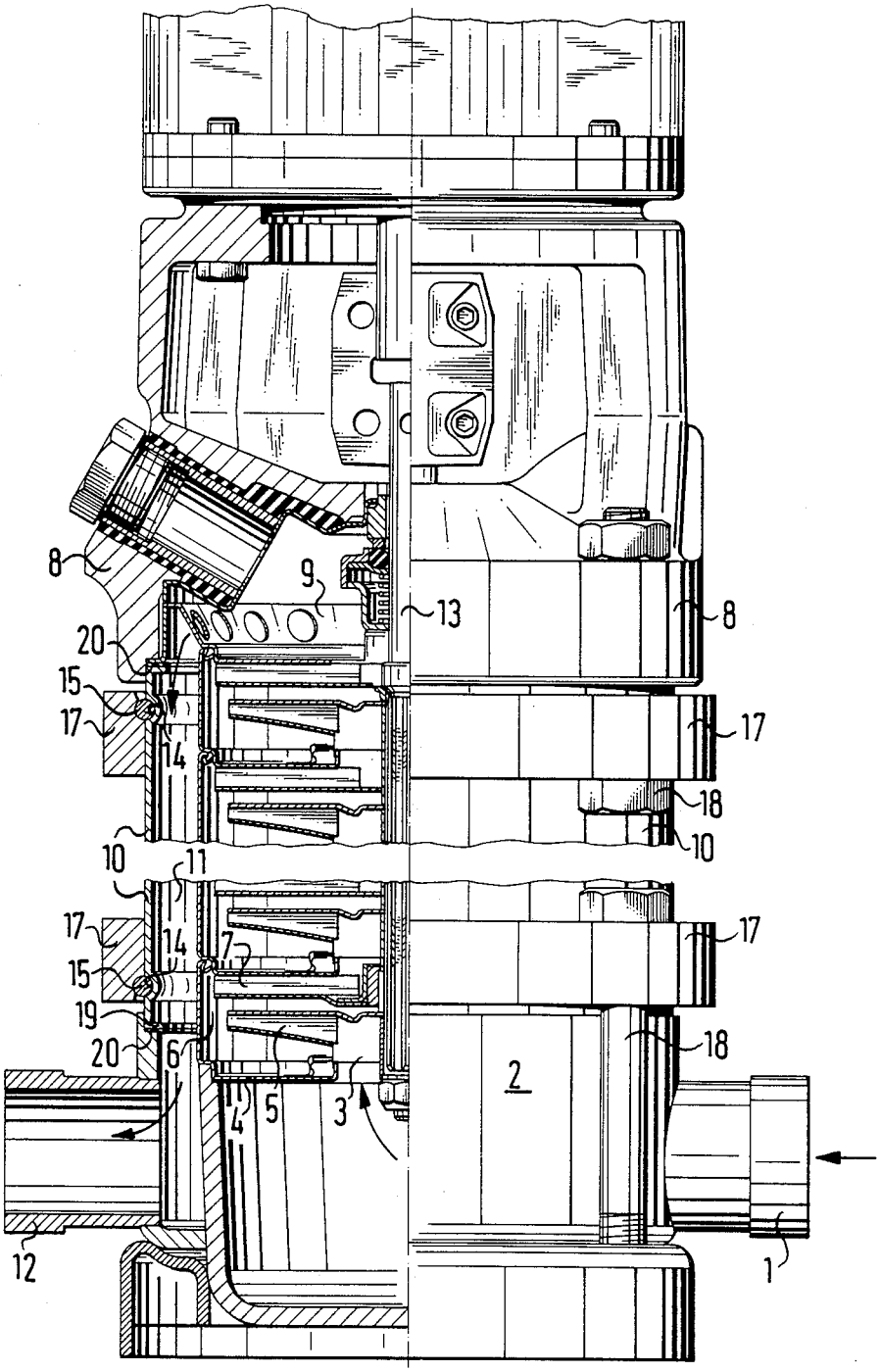
FIG. 1 shows a partially cross-sectioned side view of an in-line rotary pump.

Referring first to FIG. 1, water or another fluid enters a base element 2 of the pump via a suction connecting piece 1. The water initially passes through a suction opening 3 of a staged housing 4 into a bottom runner or impeller 5 of the first pump stage, by means of which it is impelled into an annular space 6 of the housing 4. The water then flows onwards out of the same through the passages of a return blading 7 to the impeller of the next pump stage, etc. Correspondingly, a plurality of stages may be arranged one after another depending on the pressure differential required, which then in their totality form the outwardly closed pump body.

The water conveyed to a top element 8 of the pump flows via holes of a bearing ring 9 into an annular space 11 formed by a jacket 10 and the pump body, and is led back from the same to the base element 2, at which the water emerges via a pressure connecting piece 12. A pump shaft 13 is sealed off from the environment by means of a conventional slip-ring joint.

Figure 2:
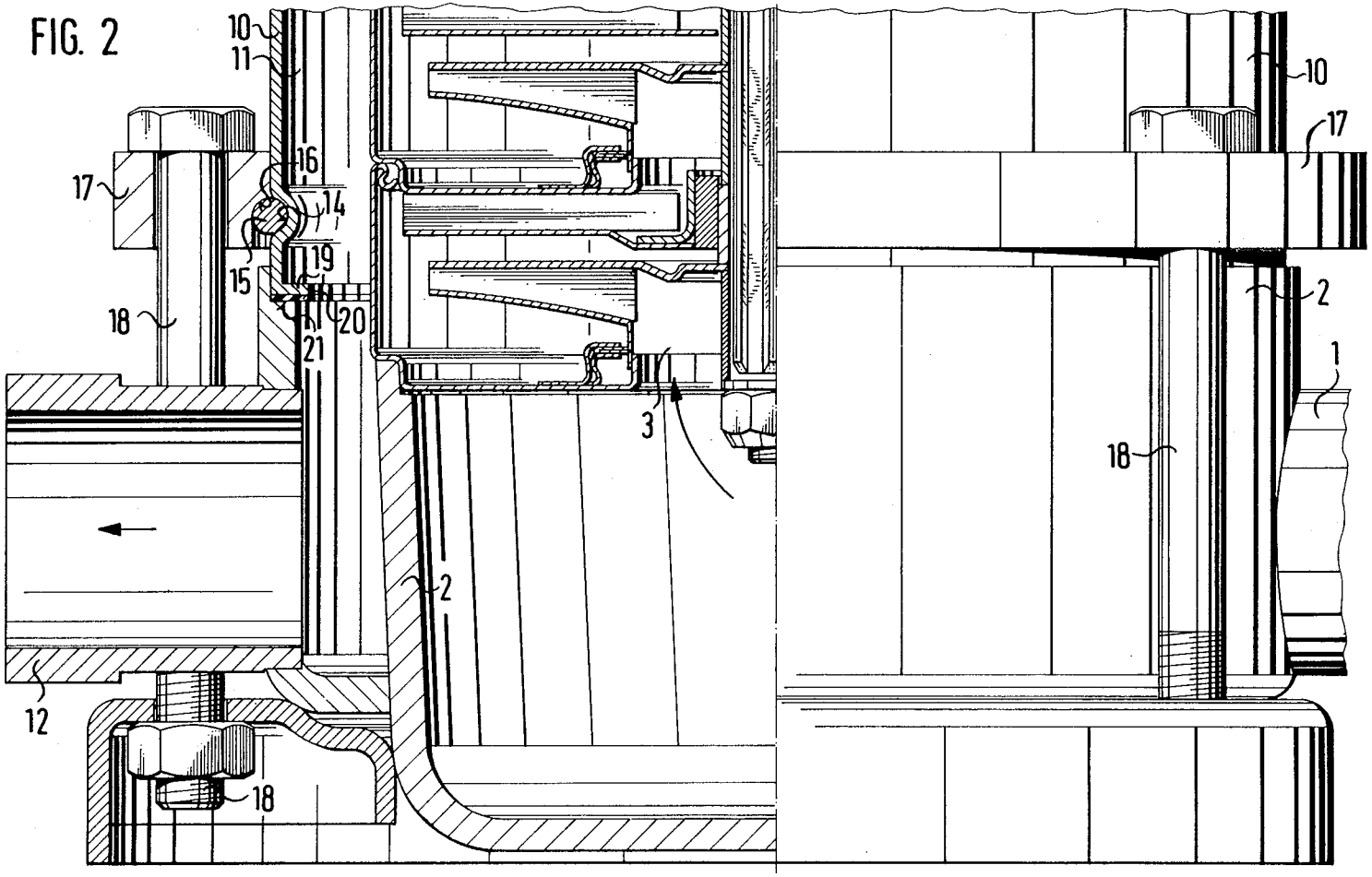
FIG. 2 shows the lower portion of the pump as illustrated in FIG. 1.

Referring to FIG. 2, the lower terminal portion of the jacket 10 has pressed into it a peripheral groove 14, into which is inserted an annular element 15 which projects outwards radially with respect to the jacket and in its upper portion forms a contact shoulder 16. On this contact shoulder 16 is seated a preferably annularly recessed clamping ring 17 extending around the jacket 10, which for its part is acted upon by several screws 18 positioned with mutual peripheral spacing, which for their part are again fastened to the base element 2 at the bottom.

The annular element 15 securely seated in the peripheral groove 14 forms a stable and load-bearing contact shoulder 16. In an alternative form of embodiment, the annular element 10 and the groove 14 may also be omitted and instead of these, the jacket may be provided in this area by plastic deformation with an integral, outwardly directed flange, the upper side of which then forms the contact shoulder in question. Another alternative consists in that an annular element is externally brazed on the jacket, wherein the upper side equally forms the contact shoulder. These alternatives are not illustrated, since they can be readily understood.

Figure 3:
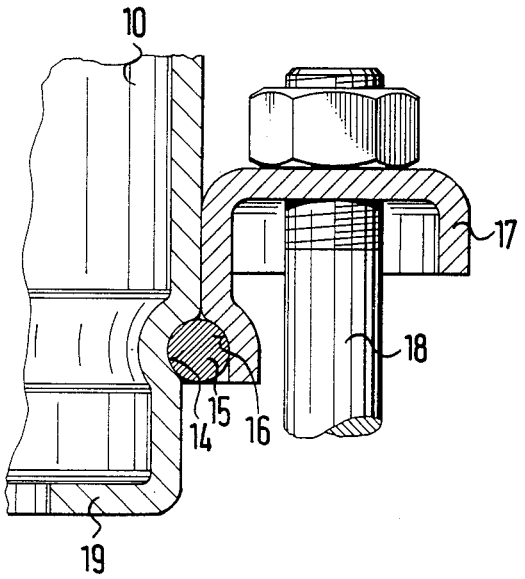
FIG. 3 shows a cross-sectional illustration of a modified embodiment of the present invention.

In FIGS. 1, 2 and 3, the peripheral groove 14 is arranged with a small spacing from the jacket extremity. It is also possible however to proceed so that the groove 14, or an equivalent configuration forming a contact shoulder, is provided at the actual jacket extremity.

Notwithstanding the form of the jacket extremity portion described in the foregoing, the lower jacket extremity may, for example, be provided with a small peripheral flange 19 which, for example, bears on a flat joint 20 which is again situated in a recess 21 of the base element 2. A radially stressable joint may alternatively also be provided, to which end the jacket extremity and/or the corresponding area of the base element are-/is constructed accordingly.

The connection between the upper extremity of the jacket 10 and the top element 8 is equivalent in all aspects to the previously described connection between the lower extremity of the jacket and the base element 2 and is therefore not described herein in detail.

An annular element pressed to shape out of metal sheet material as illustrated in FIG. 3, which may be produced economically, may also be utilized instead of a clamping ring 17 of solid material.

The embodiments shown in FIGS. 1 and 2 and in FIG. 3 differ from each only in the construction of the clamping ring 17. In FIGS. 1 and 2, the clamping ring is a solid ring as opposed to the clamping ring 17 in FIG. 3 made from a sheet metal blank.

What is claimed is:

1. A multistage rotary pump comprising a substantially closed elongated pump body which is provided at one of its extremities with a base element containing suction and pressure connecting pieces and at its other extremity with a top element and which is surrounded in spaced relationship by a jacket to form an annular return volume, and clamping means joining the jacket to the base element and the top element, the jacket being sealed with respect to these elements and being provided at least substantially close to its two extremities with contact shoulders which are acted upon by the clamping means, wherein the terminal portions of the jacket are each provided with a pressed-in peripheral groove, each of the two grooves having inserted into it an annular element projecting radially outwards with respect to the jacket and forming the said contact shoulder, and an axially stressed clamping ring acts on the said annular element.

2. A multistage rotary pump comprising a substantially closed elongated pump body which is provided at one of its extremities with a base element containing suction and pressure connecting pieces and at its other extremity with a top element and which is surrounded in spaced relationship by a jacket to form an annular return volume, and clamping means joining the jacket to the base element and the top element, the jacket being sealed with respect to these elements by means of an axially stressed joint in each case and the jacket being provided at least substantially close to its two extremities with contact shoulders which are acted upon by the clamping means, wherein the terminal portions of the jacket are each provided with a pressed-in peripheral groove, each of the two grooves having inserted into it an annular element projecting radially outwards with respect to the jacket and forming the said contact shoulder, and an axially stressed clamping ring acts on the said annular element.

* * * * *